US007002123B2

(12) United States Patent
Kim

(10) Patent No.: US 7,002,123 B2
(45) Date of Patent: Feb. 21, 2006

(54) MICROWAVE OVEN AND METHOD OF CONTROLLING THE SAME

(75) Inventor: Jun-Beom Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 621 days.

(21) Appl. No.: 10/198,138

(22) Filed: Jul. 19, 2002

(65) Prior Publication Data

US 2003/0110414 A1 Jun. 12, 2003

(30) Foreign Application Priority Data

Dec. 8, 2001 (KR) ..... 2001-77568

(51) Int. Cl.
*H05B 6/68* (2006.01)

(52) U.S. Cl. ..... 219/718; 219/716; 363/138

(58) Field of Classification Search ..... 219/718, 219/716, 702, 715, 719, 720, 721, 723, 625–626; 363/138, 45, 65, 84; 361/76, 168.1; 307/87, 307/106; 324/76.29, 76.39
See application file for complete search history.

(56) References Cited

U.S. PATENT DOCUMENTS 4,628,443 A 12/1986 Rickard et al.

FOREIGN PATENT DOCUMENTS

| | | | |
|---|---|---|---|
| JP | 55116274 A | * | 9/1980 |
| JP | 58148661 A | * | 9/1983 |
| JP | 62134567 A | * | 6/1987 |
| JP | 02139891 A | * | 5/1990 |

* cited by examiner

*Primary Examiner*—Quang Van
(74) *Attorney, Agent, or Firm*—Staas & Halsey LLP

(57) ABSTRACT

A microwave oven and a method of controlling the same. The microwave oven is capable of using a plurality of input powers with different frequencies. The microwave oven includes input power sources, an interrupt generation unit and a control unit. The interrupt generation unit generates interrupt signals with different periods according to the frequencies of the input powers. The control unit cumulatively counts pulses generated on the basis of the interrupt signals outputted from the interrupt generation unit, compares the cumulatively counted value with a reference value, and discriminates the frequencies of the input powers depending on the number of instances where the cumulatively counted value is equal to or greater than the reference value.

26 Claims, 3 Drawing Sheets

First interrupt signal
T1

Second interrupt signal
T2

Square pulse
T1+T2
2

MICROWAVE OVEN AND METHOD OF CONTROLLING THE SAME

CROSS-REFERENCE TO RELATED APPLICATIONS

This application claims the benefit of Korean Application No. 2001-77568, filed Dec. 8, 2001, in the Korean Industrial Property Office, the disclosure of which is incorporated herein by reference.

BACKGROUND OF THE INVENTION

1. Field of the Invention

The present invention relates to a microwave oven and a method of controlling the same, and more particularly to a microwave oven which can discriminate the frequencies of input powers.

2. Description of the Related Art

Generally, microwave ovens are devices which heat/cook foods using microwaves. Each of the microwave ovens has various driving devices such as a high voltage transformer and a magnetron, and is supplied with power from the outside so as to operate the driving devices. However, frequencies of powers supplied from the outside can be different according to installation environments. In general, microwave ovens use an alternating current (AC) power of 50 or 60 Hz.

A microcontroller which controls the overall operation of a microwave oven with respect to a cooking operation is installed on a circuit board within a body of the microwave oven. The microcontroller controls an operation of the driving devices according to a cooking menu set by a user and carries out the cooking operation. In addition, the microcontroller counts time based on an inputted power frequency and calculates a cooking time.

Conventional microwave ovens are each produced to correspond to the frequency of a specific power. Therefore, a microcontroller installed within a body of a conventional microwave oven performs a control operation corresponding to only one of the 50 Hz and 60 Hz AC powers. As a result, the microcontroller must calculate a cooking time based on a preset power frequency.

However, if the power whose frequency is different from that of the preset power is supplied to the conventional microwave oven, the microcontroller still calculates and measures the cooking time based on the preset power frequency which is different from the input power frequency. This, in part, results in a deterioration of the reliability of the microwave oven.

Therefore, there is a need for a microwave oven and a method of enabling a microcontroller of a microwave oven to discriminate the frequency of a supplied power from the frequency of a preset power, where the frequency of the power supplied from the outside is different from that of the power preset in the microcontroller.

SUMMARY OF THE INVENTION

Accordingly, it is an object of the present invention to provide a microwave oven and method of controlling the same, which can determine the frequency of an input power.

Additional objects and advantages of the invention will be set forth in part in the description which follows, and, in part, will be obvious from the description, or may be learned by practice of the invention.

To achieve the above and other objects of the present invention, there is provided a microwave oven capable of using a plurality of input powers with different frequencies, comprising input power sources, an interrupt generation unit which generates interrupt signals with different periods according to the frequencies of the input powers, and a control unit which cumulatively counts pulses generated on a basis of the interrupt signals outputted from the interrupt generation unit, compares an cumulatively counted value with a reference value, and discriminates the frequencies of the input powers based on a number of times where the cumulatively counted value is equal to or greater than the reference value.

To achieve the above and other objects of the present invention, there is also provided a method of controlling a microwave oven capable of using a plurality of input powers with different frequencies, the method comprising generating interrupt signals having different periods according to frequencies of the input powers, cumulatively counting pulses generated on a basis of the interrupt signals, comparing an cumulatively counted value with a reference value, cumulatively counting a number of times where the cumulatively counted value is equal to or greater than the reference value, and determining the frequencies of the input powers based on an accumulated number of times.

BRIEF DESCRIPTION OF THE DRAWINGS

The above and other objects, features and advantages of the present invention will become more apparent and more readily appreciated by describing in detail preferred embodiments thereof with reference to the accompanying drawings, in which.

DETAILED DESCRIPTION OF THE PREFERRED EMBODIMENTS

Figure 1:
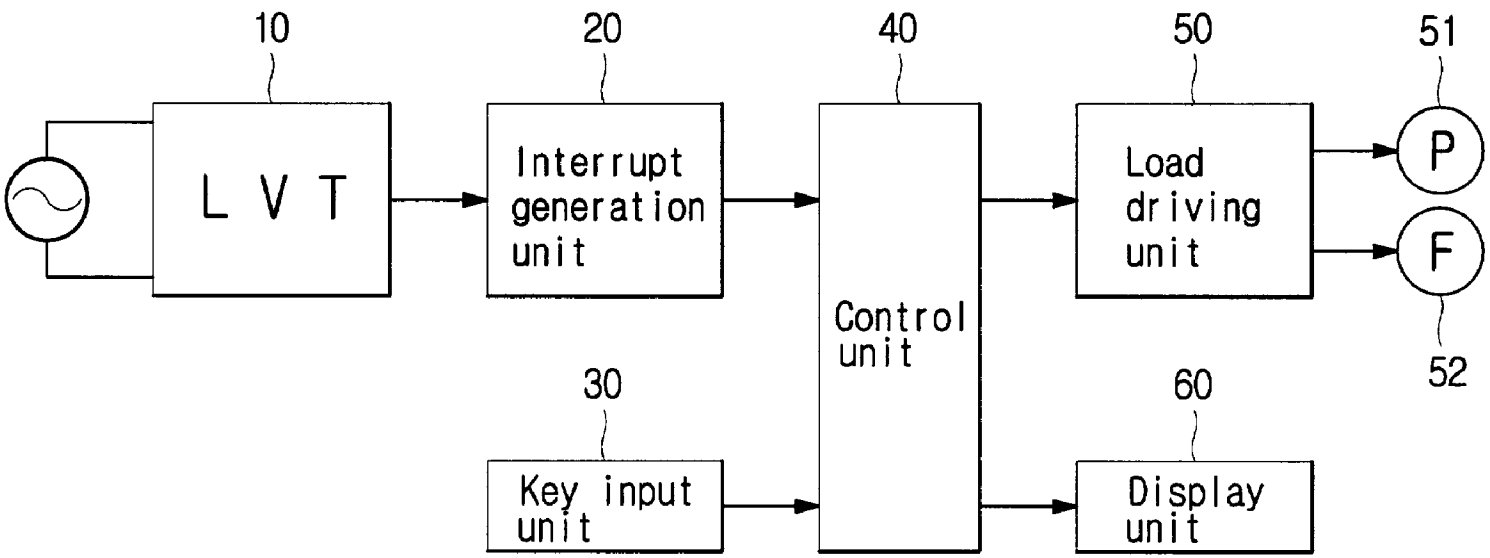
FIG. 1 is a block diagram of a microwave oven according to an embodiment of the present invention.

Reference will now be made in detail to the present preferred embodiments of the present invention, examples of which are illustrated in the accompanying drawings, wherein like reference numerals refer to like elements throughout.

FIG. 1 shows a microwave oven according to an embodiment of the present invention. The microwave oven comprises a low voltage transformer (LVT) 10, an interrupt generation unit 20 and a control unit 40. The LVT 10 drops AC 200V to a lower voltage of AC 17V and outputs the AC 17V. The interrupt generation unit 20 generates interrupt signals with different periods according to the frequencies of voltage-dropped powers of the low voltage transformer 10. The control unit 40 internally generates square pulses in response to the interrupt signals from the interrupt generation unit 20, and counts the square pulses to discriminate between the frequencies of powers.

An input terminal (not shown) of the control unit 40 is connected to a key input unit 30 having various kinds of keys including a function key which sets the cooking menu and a function key which sets cooking start/end times. The key input unit 30 outputs a key signal based on a manipulation of a corresponding function key. An output terminal (not shown) of the control unit 40 is connected to both a load driving unit 50 and a display unit 60. The load driving unit 50 drives a power relay 51 connected to various driving devices, for example, a high voltage transformer to cook foods contained in a cooking room according to a set cooking menu, and a cooling fan 52 installed in a machine room. The display unit 60 displays, for example, a cooking state of the foods.

According to an aspect of the present invention, the present invention is applied to microwave ovens which use two power sources, that is, 50 Hz and 60 Hz powers.

Figures 2A, 2B, 2C:
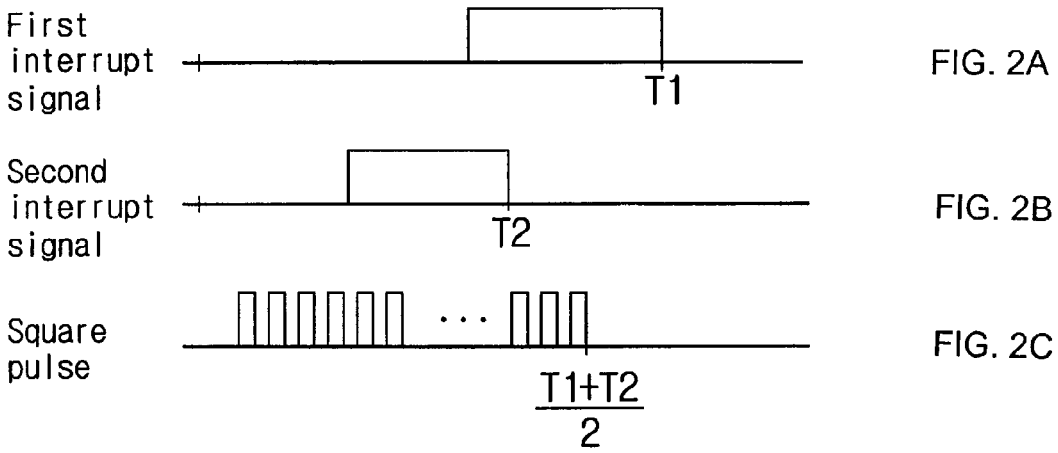
FIG. 2 is a waveform diagram showing interrupt signals of different periods and square pulses generated from the microwave oven shown in FIG. 1.

FIGS. 2A through 2C show that the interrupt generation unit 20 periodically outputs a first interrupt signal (FIG. 2A) in response to the frequency of the voltage-dropped power being 50 Hz, a second interrupt signal (FIG. 2B) in response to the frequency of the voltage-dropped power being 60 Hz. The period (T1) of the first interrupt signal is greater than that (T2) of the second interrupt signal, wherein T1 is 20 ms and T2 is 16.67 ms.

As shown in FIGS. 2A through 2C, with reference to FIG. 1, the control unit 40 internally generates the square pulses (FIG. 2C) according to the first and second interrupt signals, wherein each square pulse has a period shorter than those of the first and second interrupt signals. The control unit 40 continuously generates the square pulses in response to the input interrupt signals, and simultaneously and cumulatively counts the square pulses using an internal counter.

The first or second interrupt signal is periodically inputted to the control unit 40 according to the power which is voltage-dropped by the low voltage transformer 10 and applied to the interrupt generation unit 20. The control unit 40 cumulatively counts the square pulses for each of these periods.

At this point, it should be understood that the power supplied from the outside can be varied temporarily. Even though the power supplied from the outside may be slightly lower or higher than 50 Hz in its frequency, it is reasonable to consider the supplied power as 50 Hz power. Similarly, even though the power supplied from the outside may be slightly lower or higher than 60 Hz in its frequency, it is reasonable to consider the supplied power as 60 Hz power.

The control unit 40 can, as many times as it is set to, determine whether the cumulatively counted value of the square pulses is equal to or greater than a reference value. Therefore, the reference value can be set to distinguish between the powers having a corresponding 50 Hz and 60 Hz. The reference value, as shown in FIG. 2, may correspond to a value obtained by cumulatively counting the square pulses during an average period, which is the arithmetic average of the period (T1) of the first interrupt signal and the period (T2) of the second interrupt signal. Therefore, if the cumulatively counted value does not reach the reference value, a determination is made that the second interrupt signal is generated and the power having 60 Hz is being supplied to the microwave oven. On the other hand, if the cumulatively counted value is equal to or greater than the reference value, a determination is made that the first interrupt signal is generated and the power having 50 Hz is being supplied to the microwave oven.

The control unit 40 performs an operation to discriminate the frequency of the power after a predetermined period of time as, in general, stable power is not supplied initially after the manipulation of a power code. Furthermore, the control unit 40 counts, several times, the number of times where the cumulatively counted value is equal to or greater than the reference value even after the passage of the predetermined period of time, and determines the frequency of the power if the accumulated number of times is equal to or greater than a preset number. Therefore, the accuracy of discriminating the frequency of the power is increased.

Figure 3:
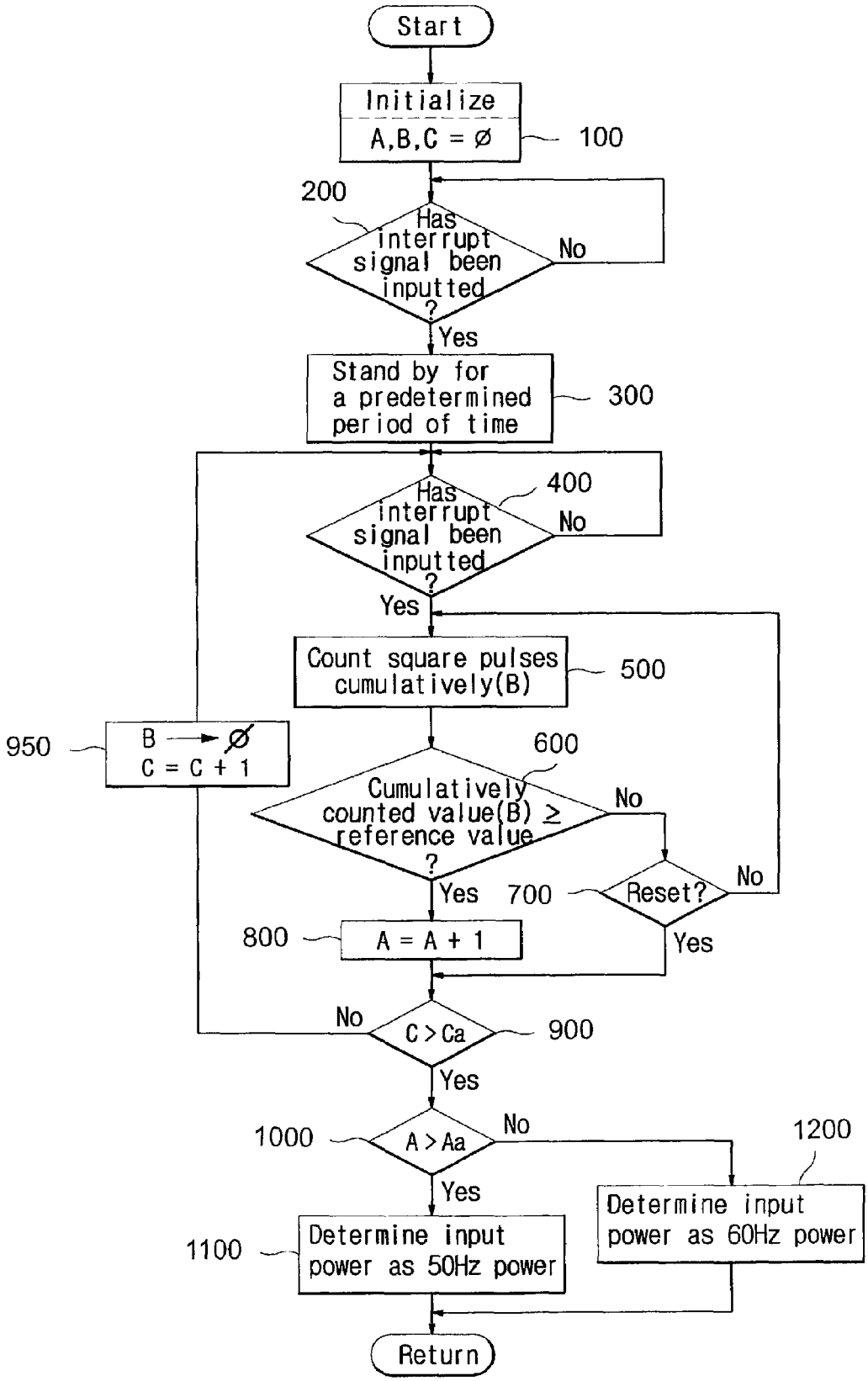
FIG. 3 is a flowchart of a method of controlling a microwave oven according to an embodiment of the present invention.

FIG. 3, with reference to FIG. 1, shows a method of controlling a microwave oven according to the present invention.

In operation 100, the control unit 40 performs an initializing operation in response to a supply of an input driving power from a power supply unit (not shown). The control unit 40 sets the initial value of variables, for example A, B and C, to "0," to determine the frequency of the power.

In operation 200, the low voltage transformer 10 drops the voltage of the AC power and outputs a voltage-dropped AC power to the interrupt generation unit 20. The interrupt generation unit 20 outputs a first or second interrupt signal corresponding to the frequency of the voltage-dropped AC power to the control unit 40, and the control unit 40 determines whether the first or second interrupt signal has been inputted.

In operation 300, where the first or second interrupt signal has been inputted from the interrupt generation unit 20, the control unit 40 stands by for a predetermined period of time (several seconds). At this time, the interrupt generation unit 20 periodically outputs a corresponding interrupt signal, while the control unit 40 internally and periodically generates the square pulses.

In operation 400, after the elapse of the predetermined period of time, the control unit 40 determines whether the first or second interrupt signal has been inputted. In this case, if it is determined that an interrupt signal is not inputted, the control unit 40 stands by until the interrupt signal is generated. On the other hand, if it is determined that an interrupt signal has been inputted, the control unit 40 cumulatively counts the square pulses generated internally using an internal counter and updates a cumulatively counted value (B) in operation 500.

In operation 600, the control unit 40 then determines whether the cumulatively counted value (B) is equal to or greater than a reference value (that is, a value obtained by cumulatively counting the square pulses during an average period), which is the arithmetic average of the period (T1) of the first interrupt signal and the period (T2) of the second interrupt signal.

In operation 700, if the cumulatively counted value (B) is less than the reference value according to the determination result in operation 600, the control unit 40 determines whether the internal counter is reset. This is due to the fact that the control unit 40 resets the internal counter and then recounts the square pulses before the counted value (B) reaches the reference value if the power supplied is 60 Hz, because the reference value is between the periods of first and second interrupt signals. If the internal counter is not reset according to the determination result in operation 700, that is, if the first interrupt signal is inputted, or the second signal does not reach the period (T2) even though the second interrupt signal is inputted, the control unit 40 returns to operation 500 so as to continue to count the square pulses. If the internal counter is reset according to the determination result in operation 700, that is, if the second interrupt signal reaches the period (T2), the control unit 40 proceeds to operation 900.

On the other hand, if the cumulatively counted value (B) is equal to or greater than the reference value according to the determination result in operation 600, the control unit 40 increases a power frequency state variable (A) by 1 in operation 800.

In operation 900, it is determined whether an accumulation state variable (C) is greater than a preset number (Ca). In this case, the preset number (Ca) is set to 20. If the accumulation state variable (C) is not greater than the preset number (Ca), according to the determination result in operation 900, the control unit 40 clears the power frequency state variable (A), increases the cumulation state variable (C) by 1 in operation 950 and then returns to operation 400. If the accumulation state variable (C) is greater than the preset number (Ca), according to the determination result in operation 900, the control unit 40 determines whether the power frequency state variable (A) is greater than a preset value (Aa) in operation 1000. In this case, the preset value (Aa) is set to 10.

If the power frequency state variable (A) is greater than the preset value (Aa), according to the determination result in operation 1000, the number of times where the cumulatively counted value (B) is equal to or greater than the reference value is high, resulting in the control unit 40 determining the input power as 50 Hz power in operation 1100 and returning to the initial operation. On the other hand, if the power frequency state variable (A) is not greater than the preset value (Aa), the number of times where the cumulatively counted value (B) is equal to or greater than the reference value is low, resulting in the control unit 40 determining the input power as 60 Hz power in operation 1200 and returning to the initial operation.

As described above, the present invention provides a microwave oven and a method of controlling the same, which counts the number of times where a cumulatively counted value is equal to or greater than a reference value, and determines the frequency of power where the accumulated number of times is equal to or greater than a preset number. Accordingly, the frequency of the power supplied from the outside can be exactly discriminated, thus increasing the reliability of the microwave oven.

While the present invention has been described with respect to a microwave oven which can utilize 50 Hz and 60 Hz power sources, it is understood that the present invention can be applied to a microwave oven which can utilize other frequency power sources and/or more than two power sources. That is, a microwave oven and a method of controlling the same according to the present invention can discriminate more than two corresponding frequencies of input powers.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A microwave oven useable with a plurality of input powers with different frequencies, comprising:

input power sources which transmit the corresponding input powers;

an interrupt generation unit which generates interrupt signals having different periods according to the different frequencies of the input powers; and a control unit which cumulatively counts pulses generated on a basis of the interrupt signals outputted from the interrupt generation unit, compares a cumulatively counted value with a reference value, and discriminates the different frequencies of the input powers depending on a number of times where the cumulatively counted value is equal to or greater than the reference value.

2. The microwave oven according to claim 1, further comprising a low voltage generation unit which drops a voltage of each input power and outputs a voltage-dropped input power to the interrupt generation unit, wherein the interrupt generation unit generates one of the interrupt signals having a period corresponding to a level of increase/decrease in frequency of the voltage-dropped input power.

3. The microwave oven according to claim 2, wherein the interrupt generating unit generates the one interrupt signal having a corresponding short period in response to an increase in frequency of the voltage-dropped input power, and generates the one interrupt signal having a corresponding long period in response to a decease in frequency of the voltage-dropped input power.

4. The microwave oven according to claim 2, further comprising:

a key input unit connected to the control unit;

a display unit connected to the control unit;

a cooling fan installed in a machine room of the microwave oven;

a power relay connected to driving devices of the microwave oven including a high voltage transformer; and a load driving unit which is connected to the control unit and drives the power relay and the cooling fan.

5. The microwave oven according to claim 1, wherein the reference value is obtained by cumulatively counting the pulses during an average period, which is an arithmetic average of a period of an input power having a higher frequency of two input powers, and a period of an input power having a lower frequency of the two input powers.

6. The microwave oven according to claim 5, wherein the two input powers comprise frequencies of 50 Hz and 60 Hz, respectively.

7. The microwave oven according to claim 6, wherein the controller determines the input power as having a frequency of 50 Hz in response to the number of times accumulated being greater than a preset value, and determines the input power as having a frequency of 60 Hz in response to the number of times accumulated being not greater than the preset value.

8. The microwave oven according to claim 1, wherein the control unit cumulatively counts a number of the comparisons of the cumulatively counted value and the reference value, and continues to count until the number of comparisons reaches a reference number.

9. The microwave oven according to claim 1, wherein the controller determines one of the input powers as having a lower frequency of two input powers in response to the number of times accumulated being greater than a preset value, and determines the one input power as having a higher frequency of the two input powers in response to the number of times accumulated being not greater than the preset value.

10. The microwave oven according to claim 9, wherein the two input powers comprise frequencies of 50 Hz and 60 Hz, respectively.

11. The microwave oven according to claim 1, wherein the controller waits for a set time prior to performing an operation to discriminate the different frequencies of the input powers, wherein the controller counts the number of times where the accumulated value is equal to or greater than the reference value during and after the set time.

12. The microwave oven according to claim 1, wherein the control unit further controls a cooking operation of the microwave oven based on the discrimination of the different frequencies of the input powers.

13. A method of controlling a microwave oven useable with a plurality of input powers with different frequencies, the method comprising:

generating interrupt signals having different periods according to the different frequencies of the input powers;

cumulatively counting pulses generated on a basis of the interrupt signals;

comparing a cumulatively counted value with a reference value;

cumulatively counting a number of times where the cumulatively counted value is equal to or greater than the reference value; and determining the different frequencies of the input powers depending on the number of times accumulated.

14. The method according to claim 13, further comprising dropping a voltage of each input power, wherein the generating of the interrupt signals comprises generating one of the interrupt signals having a period corresponding to a level of increase/decrease in frequency of each voltage-dropped input power.

15. The method according to claim 14, wherein the generating of the interrupt signal comprises:

generating the one interrupt signal having a corresponding short period in response to an increase in frequency of the voltage-dropped input power; and generating the one interrupt signal having a corresponding long period in response to a decease in frequency of the voltage-dropped input power.

16. The method according to claim 13, wherein the reference value is obtained by cumulatively counting the pulses during an average period, which is an arithmetic average of a period of an input power having a higher frequency of two input powers and a period of an input power having a lower frequency of the two input powers.

17. The method according to claim 16, wherein the two input powers comprise frequencies of 50 Hz and 60 Hz, respectively.

18. The method according to claim 17, wherein the determining of the different frequencies comprises:

determining the input power as having a frequency of 50 Hz in response to the number of times accumulated being greater than a preset; and determining the input power as having a frequency of 60 Hz in response to the number of times accumulated being not greater than the preset value.

19. The method according to claim 13, wherein the comparing of the cumulatively counted value with the reference value comprises:

cumulatively counting a number of the comparisons; and continuing to count the number of the comparisons until the number of the comparisons reaches a reference number.

20. The method according to claim 13, wherein the determining of the different frequencies comprises:

determining an input power as having a tower frequency of two input powers in response to the number of times accumulated being greater than a preset value; and determining the input power as having a higher frequency of the two input powers in response to the number of times accumulated being not greater than the preset value.

21. The method according to claim 20, wherein the two input powers comprise frequencies of 50 Hz and 60 Hz, respectively.

22. The method according to claim 13, further comprising controlling a cooking operation of the microwave oven based on the determination of the different frequencies of the input powers.

23. The method according to claim 13, further comprising controlling a cooking operation of the microwave oven based on the determination of the different frequencies of the input powers.

24. A microwave oven useable with a plurality of input powers with different frequencies, comprising:

a control unit which cumulatively counts pulses generated on a basis of interrupt signals, compares a cumulatively counted value with a reference value, and discriminates the different frequencies of the input powers depending on a number of times where the cumulatively counted value is equal to or greater than the reference value.

25. The microwave oven according to claim 24, wherein the control unit further controls a cooking operation of the microwave oven based on the discrimination of the different frequencies of the input powers.

26. The apparatus according to claim 24, further comprising an interrupt generation unit which generates interrupt signals having different periods according to the different frequencies of the input powers.

* * * * *

UNITED STATES PATENT AND TRADEMARK OFFICE

CERTIFICATE OF CORRECTION

PATENT NO. : 7,002,123 B2
APPLICATION NO. : 10/198138
DATED : February 21, 2006
INVENTOR(S) : Jun-Beom Kim It is certified that error appears in the above-identified patent and that said Letters Patent is hereby corrected as shown below:

Column 6, line 9, after “unit” insert --:--

Column 6, line 14, change “decease” to --decrease--

Column 7, line 28, change “decease” to --decrease--

Column 8, line 10, change “tower” to --lower--

Signed and Sealed this

Twenty-fourth Day of October, 2006

JON W. DUDAS
*Director of the United States Patent and Trademark Office*